US006454187B1

(12) United States Patent
Wang

(10) Patent No.: US 6,454,187 B1
(45) Date of Patent: Sep. 24, 2002

(54) WATER EMISSION CONTROL STRUCTURE OF GARDENING PISTOL NOZZLE

(76) Inventor: Hsin-Fa Wang, P.O. Box 453, Taichung (TW)

( * ) Notice: Subject to any disclaimer, the term of this patent is extended or adjusted under 35 U.S.C. 154(b) by 0 days.

(21) Appl. No.: 09/862,306

(22) Filed: May 23, 2001

(51) Int. Cl.[7] ..... B05B 7/02
(52) U.S. Cl. ..... 239/526; 239/586
(58) Field of Search ..... 239/525, 526, 239/583, 556

(56) References Cited

U.S. PATENT DOCUMENTS 4,909,443 A * 3/1990 Takagi ..... 239/440
5,630,548 A * 5/1997 Chih ..... 239/394
5,984,207 A * 11/1999 Wang ..... 239/526
6,390,390 B1 * 5/2002 Hung ..... 239/525

* cited by examiner

*Primary Examiner*—Lisa A. Douglas

(57) ABSTRACT

A gardening pistol nozzle has a water emission control structure comprising a handle tube, a water stopping stem, a press key, and a recovery button. As the press key is pressed, the water stopping stem is forced to displace to allow entry of water from the handle tube into a barrel of the pistol nozzle. A continuous control of water emission of a predetermined magnitude is attained by meshing a retaining block of the recovery button into the teeth of a rack of the press key.

1 Claim, 5 Drawing Sheets

WATER EMISSION CONTROL STRUCTURE OF GARDENING PISTOL NOZZLE

BACKGROUND OF THE INVENTION

1. Field of the Invention

The present invention relates generally to a gardening pistol nozzle, and more particularly to a water emission control structure of the gardening pistol nozzle.

2. Description of Related Art

The conventional pistol nozzle comprises a control lever by which the water emission of the conventional pistol nozzle is controlled. However, a user of the conventional pistol nozzle must keep holding the control lever in the trigger position so as to enable the pistol nozzle to emit water without interruption. It is conceivably tiresome for the user of the conventional pistol nozzle to hold continuously the control lever in the trigger position. In addition, the magnitude of the water emission of the conventional pistol nozzle is also controlled manually by the control lever. It is difficult to regulate the magnitude of the water emission with precision by means of the manual control lever.

BRIEF SUMMARY OF THE INVENTION

The primary objective of the present invention is to provide a gardening pistol nozzle which is free of the drawbacks of the conventional gardening pistol nozzle described above.

In keeping with the principle of the present invention, the foregoing objective of the present invention is attained by the gardening pistol comprising a handle which is provided with a press key and a recovery button for an automatic control of water emission of the gardening pistol nozzle. The press key comprises a unidirectional rack, whereas the recovery button comprises a retaining block engageable with the rack. The water emission control of the gardening pistol nozzle of the present invention is attained with ease by meshing the retaining block of the recovery button into the rack of the press key.

The features, functions, and advantages of the present invention will be more readily understood upon a thoughtful deliberation of the following detailed description of the present invention with reference to the accompanying drawings.

DETAILED DESCRIPTION OF THE INVENTION

Figure 1:
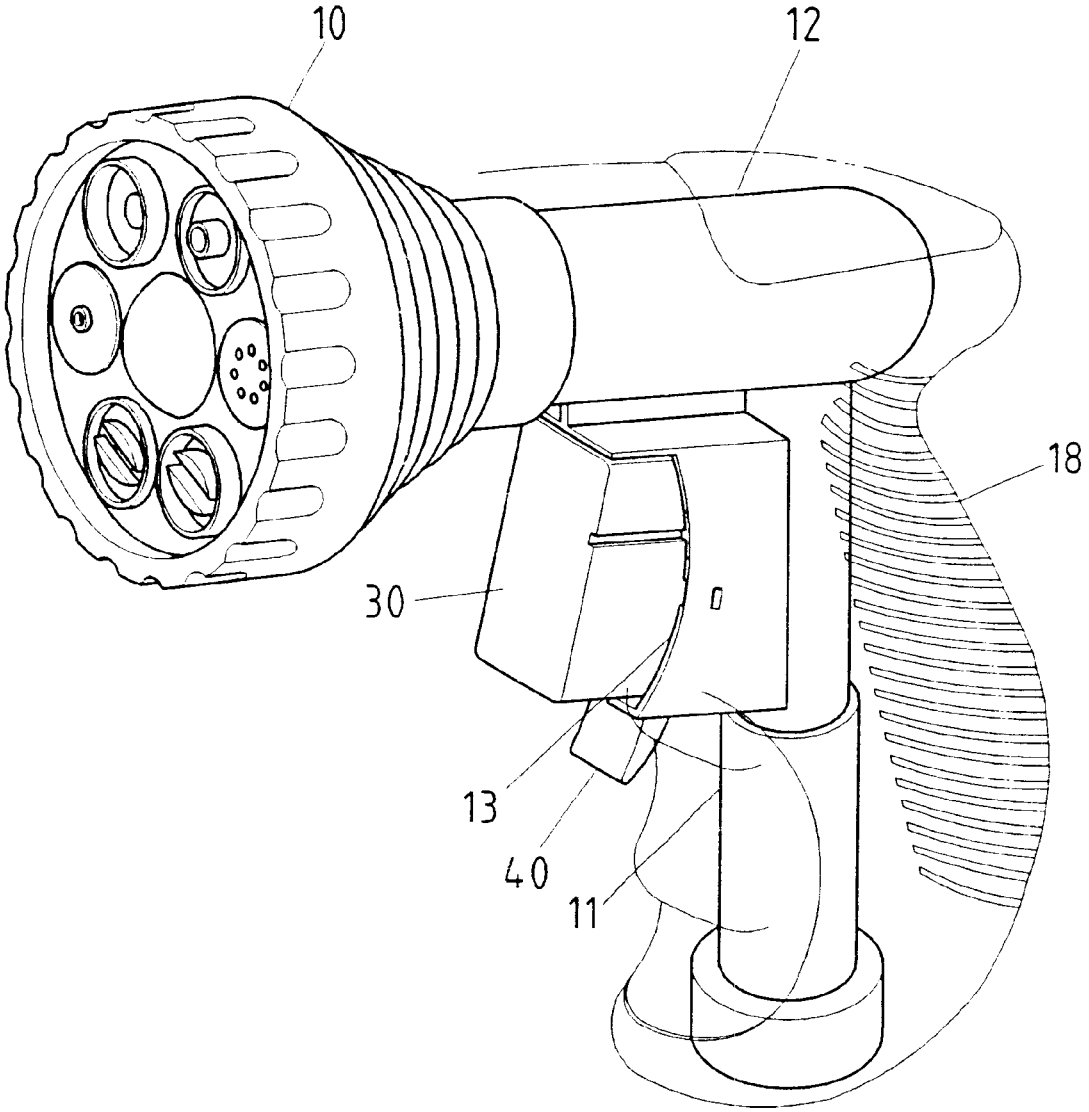
FIG. 1 shows a perspective view of the present invention.
Figure 2:
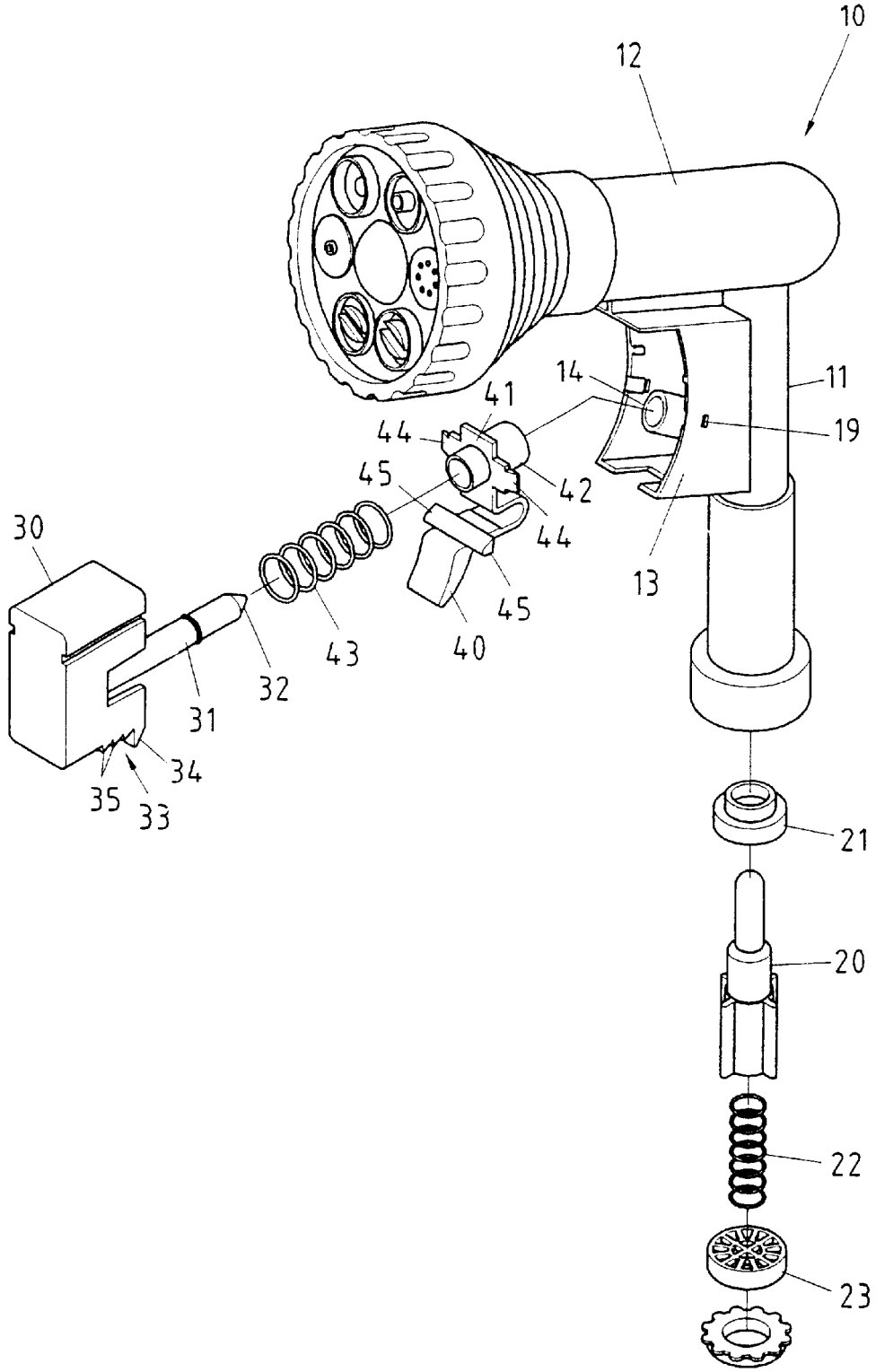
FIG. 2 shows an exploded view of the present invention.

As shown in FIGS. 1–5, gardening pistol nozzle of the present invention comprises a water emission control structure comprising a main body 10, a water stopping stem 20, a press key 30, and a recovery button 40.

The main body 10 is formed of a handle tube 11 and a barrel 12. The handle tube 11 is provided with a receiving slot 13 in which a tubular body 14 is located such that the tubular body 14 is in communication with the handle tube 11. The handle tube 11 is provided at the bottom end with a hose connecting hole 15, a receiving cell 16, and a water channel 17 smaller in diameter than the receiving cell 16. The handle tube 11 is provided with a grip cover 18 fitted thereover. The grip cover 18 is made of a rubber material. The main body 10 is provided with two retaining slots 19.

The water stopping stem 20 is disposed in the receiving cell 16 of the handle tube 11 in conjunction with a washer 21 which is fitted over the top end of the water stopping stem 20 and is located at the junction between the receiving cell 16 and the water cannel 17 of the handle tube 11. The water stopping 20 is provided in the bottom end with a spring 22 fitted thereinto. Located at the junction of the hose connecting hole 15 and the receiving cell 16 is a meshed plate 23 for locating the water stopping stem 20 and the spring 22 in the receiving cell 16.

The press key 30 is provided in the internal side with a push rod 31 extending therefrom and having a tapered free end 32. The press key 30 is provided in the underside with a unidirectional rack 33 which is in turn provided at one end with a stop tooth 34. The press key 30 is accommodated in the receiving slot 13 of the handle tube 11.

Figure 3:
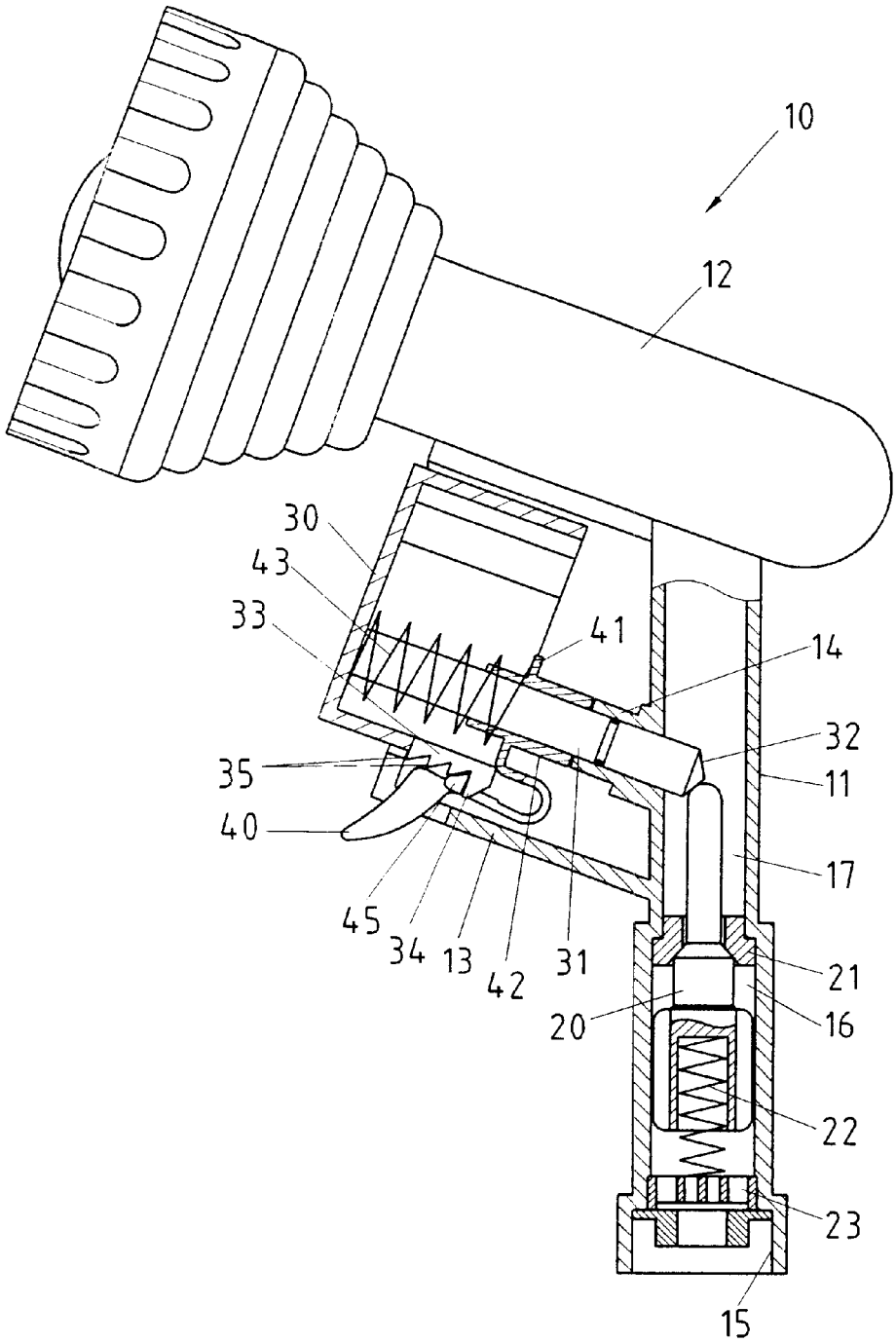
FIG. 3 shows a longitudinal sectional view of the present invention in combination.

The recovery button 40 is provided with a tubular portion 42 having a stop plate 41. The stop plate 41 has two connection edges 44 opposite in location to each other. The recovery button 40 is further provided with a retaining block 45 engageable with the teeth 35 of the rack 33. A recovery spring 43 is fitted over the tubular portion 42, and the push rod 31 of the press key 30. The recovery button 40 and the press key 30 are disposed in the receiving slot 13 of the handle tube 11 such that one end of the spring 43 is stopped by the stop plate 41 of the recovery button 40, and that the push rod 31 of the press key 30 is put through the tubular portion 42 of the recovery button 40, and further that the tapered free end 32 of the push rod 31 is in contact with the top end of the water stopping stem 20, as shown in FIG.3. The water stopping stem 20 obstructs the water channel 17, thereby preventing water to flow into the water channel 17. As a result, there is no water emission via the barrel 12. It must be added here that the two connection edges 44 of the recovery button 40 are retained by the two retaining slots 19 of the main body 10.

Figure 4:
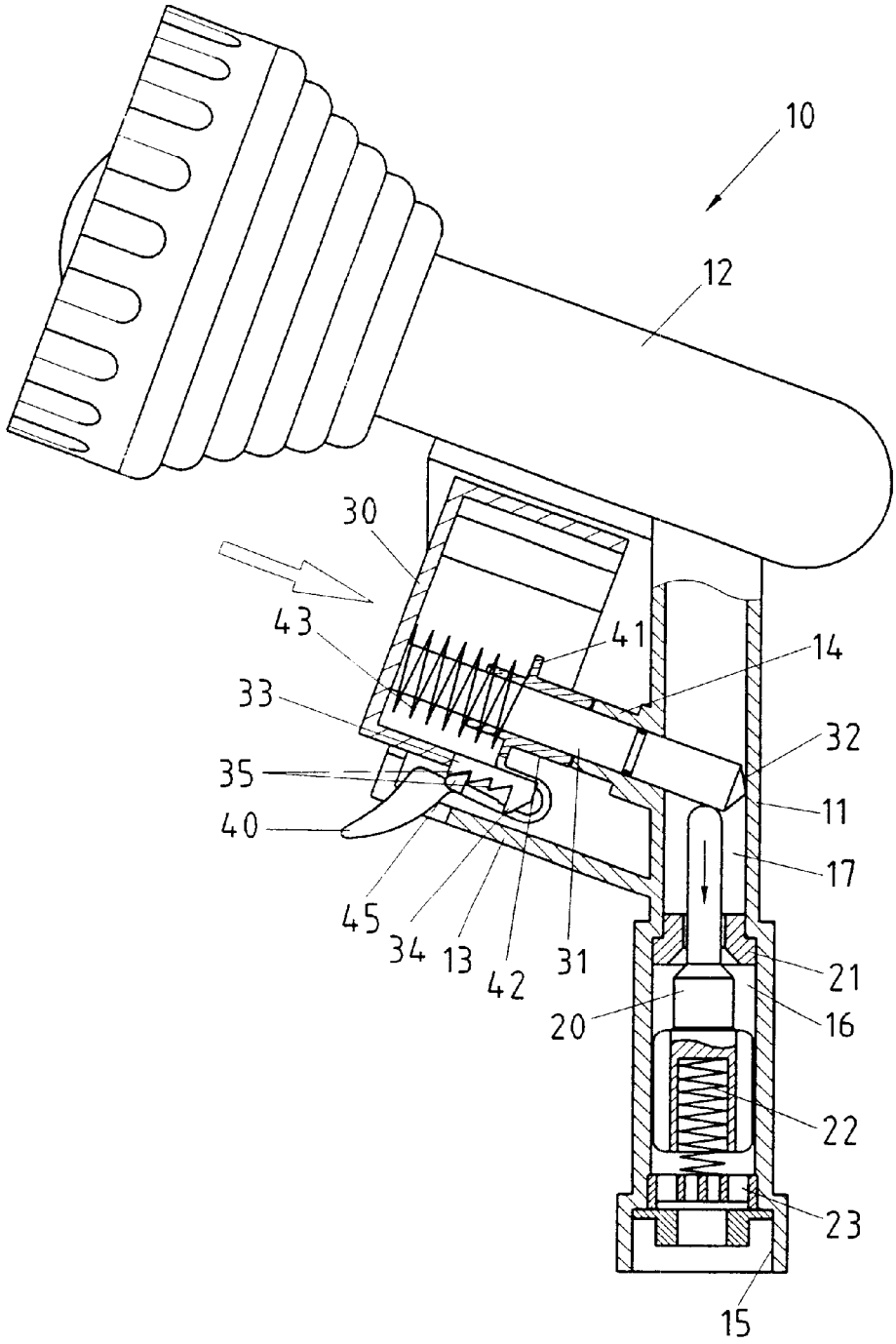
FIG. 4 shows a sectional schematic view of the present invention in action.

As illustrated in FIG. 4, the press key 30 is pressed such that the push rod 31 pushes the top end of the water stopping stem 20, thereby resulting in the downward displacement of the water stopping stem 20. As soon as the press key 30 is relieved of the external force exerting thereon, the retaining block 45 of the recovery button 40 is under the influence of the spring force of the recovery spring 43 such that the retaining block 45 meshes into one of the teeth 35 of the rack 33 from the position of the stop tooth 34 of the rack 33. As a result, the water stopping stem 20 is located at the displacement position thereof. The amount of the water that is allowed into the water channel 17 of the handle tube 11 depends on the distance of the displacement of the water stopping stem 20.

Figure 5:
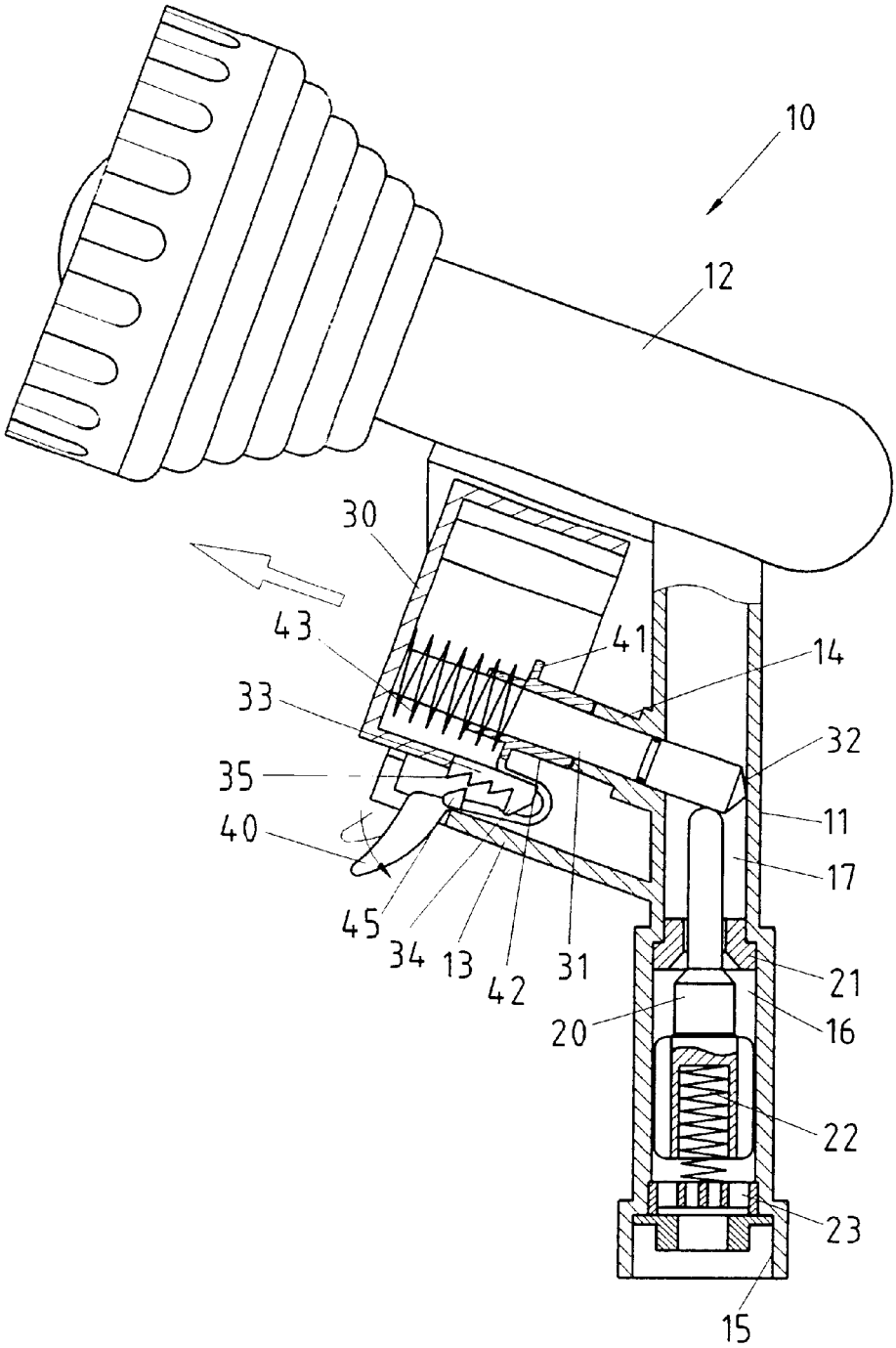
FIG. 5 shows another sectional schematic view of the present invention in action.

As shown in FIG. 5, the water emission is completely stopped by triggering the recovery button 40, as illustrated by a small black arrow. As soon as the recovery button 40 is triggered, the retaining block 45 of the recovery button 40 is disengaged with the tooth 35 of the rack 33. In the meantime, the press key 30 is forced by the spring force of the recovery spring 43 to return to its original position as shown in FIG. 3. The water channel 17 of the handle tube 11 is once again obstructed by the water stopping stem 20.

I claim:

1. A water emission control structure of a gardening pistol nozzle, said control structure comprising:

a main body formed of a handle tube and a barrel in communication with said handle tube, said handle tube provided with a receiving slot attached thereto, and a tubular body located in said receiving slot such that said tubular body is in communication with said handle tube, said handle tube further provided at a bottom end with a hose connecting hole, a receiving cell contiguous to said hose connecting hole, and a water channel contiguous to said receiving cell, said water channel being smaller in diameter than said receiving cell;

a water stopping stem disposed in said receiving cell of said handle tube in conjunction with a washer which is fitted over a top end of said water stopping stem and is located at the junction of said receiving cell and said water channel, said water stopping stem being provided at a bottom end with a spring fitted thereinto, said water stopping stem and said spring being located by a meshed plate which is located at the junction of said hose connecting hole and said receiving cell;

a press key provided in an internal side with a push rod extending therefrom and having a tapered free end, said press key further provided in an underside with a unidirectional rack which is provided with a plurality of teeth and a stop tooth located at one end of said rack; and a recovery button provided with a tubular portion having a stop plate, said stop plate provided with two connection edges opposite in location to each other, said recovery button further provided with a retaining block engageable with said teeth of said rack of said press key, said recovery button further provided with a recovery spring which is fitted at one end over said tubular portion, and at other end over said push rod of said press key whereby said recovery button and said press key are disposed in said receiving slot of said handle tube such that said one end of said recovery spring is stopped by said stop plate of said recovery button, and that said push rod of said press key is put through said tubular portion of said recovery button, and further that said tapered free end of said push rod is in contact with said top end of said water stopping stem, and further that said two connection edges of said stop plate of said recovery button are retained in two retaining slots of said main body;

said top end of said water stopping stem being pushed by said tapered free end of said push rod of said push key at such time when said press key is exerted on by an external force, thereby resulting in a displacement of said water stopping stem in the direction away from said water channel of said handle tube so as to allow water to enter said water channel from said hose connecting hole of said handle tube, said retaining block of said recovery button being forced by said recovery spring to mesh into one of said teeth of said rack of said press key at such time when said press key is relieved of the external force, said retaining block of said recovery button becoming disengaged with the tooth of said rack at the time when said recovery button is triggered, thereby causing said press key to be forced back to an original position thereof by said recovery spring such that said tapered free end of said push rod of said press key is in contact with said top end of said water stopping stem, and that said water channel of said handle tube is obstructed by said water stopping stem.

* * * * *